US009496608B2

(12) United States Patent
Jiang et al.

(10) Patent No.: US 9,496,608 B2
(45) Date of Patent: Nov. 15, 2016

(54) TUNABLE MULTIBAND ANTENNA WITH PASSIVE AND ACTIVE CIRCUITRY

(71) Applicant: Apple Inc., Cupertino, CA (US)

(72) Inventors: Yi Jiang, Sunnyvale, CA (US); Siwen Yong, Santa Clara, CA (US); Gordon Coutts, Santa Clara, CA (US); Lijun Zhang, San Jose, CA (US); Qingxiang Li, Mountain View, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 660 days.

(21) Appl. No.: 13/864,968

(22) Filed: Apr. 17, 2013

(65) Prior Publication Data

US 2014/0313087 A1 Oct. 23, 2014

(51) Int. Cl.

| | |
|---|---|
| ***H01Q 9/00*** | (2006.01) |
| ***H01Q 3/22*** | (2006.01) |
| ***H01Q 1/24*** | (2006.01) |
| ***H01Q 1/44*** | (2006.01) |

(52) U.S. Cl.

CPC ..... *H01Q 3/22* (2013.01); *H01Q 1/243* (2013.01); *H01Q 1/245* (2013.01); *H01Q 1/44* (2013.01)

(58) Field of Classification Search

CPC ..... H01Q 3/22; H01Q 1/245; H01Q 1/243; H01Q 1/44

USPC ..... 343/745, 700 MS, 722, 749

See application file for complete search history.

(56) References Cited

U.S. PATENT DOCUMENTS

| | | | |
|---|---|---|---|
| 6,836,249 | B2 | 12/2004 | Kenoun et al. |
| 7,372,406 | B2 | 5/2008 | Shiotsu |

(Continued)

FOREIGN PATENT DOCUMENTS

| | | |
|---|---|---|
| EP | 1699109 | 9/2006 |
| TW | 562256 | 11/2003 |

(Continued)

OTHER PUBLICATIONS

Yarga et al., U.S. Appl. No. 13/790,549, filed Mar. 8, 2013.

(Continued)

*Primary Examiner* — Sue A Purvis
*Assistant Examiner* — Jae Kim
(74) *Attorney, Agent, or Firm* — Treyz Law Group, P.C.; G. Victor Treyz; Michael H. Lyons

(57) ABSTRACT

An electronic device may have an antenna for providing coverage in wireless communications bands of interest such as a low frequency communications band and a high frequency communications band. The antenna may have an antenna ground and an antenna resonating element. The antenna resonating element may have a high band arm that contributes to a first high band resonance in the high band and may have a low band arm that exhibits a low band resonance in the low band. A passive filter that is coupled between first and second portions of the antenna resonating element may be configured to exhibit a short circuit impedance associated with a bypass path that allows the antenna resonating element to contribute to a second high band resonance in the high band.

22 Claims, 9 Drawing Sheets

(56) References Cited

U.S. PATENT DOCUMENTS

| | | | | |
|---|---|---|---|---|
| 8,000,737 | B2 | 8/2011 | Caimi et al. | |
| 8,164,538 | B2 | 4/2012 | Montgomery et al. | |
| 8,432,322 | B2 | 4/2013 | Amm et al. | |
| 2004/0204189 | A1 | 10/2004 | Guetre et al. | |
| 2009/0174611 | A1 | 7/2009 | Schlub et al. | |
| 2010/0053007 | A1* | 3/2010 | Ni | H01Q 9/0421 343/745 |
| 2010/0060528 | A1* | 3/2010 | Chiu | H01Q 1/243 343/700 MS |
| 2011/0012794 | A1 | 1/2011 | Schlub et al. | |
| 2011/0050509 | A1 | 3/2011 | Ayala Vazquez et al. | |
| 2012/0068893 | A1 | 3/2012 | Guterman et al. | |
| 2012/0214412 | A1 | 8/2012 | Schlub et al. | |
| 2012/0223865 | A1 | 9/2012 | Li et al. | |
| 2012/0223866 | A1* | 9/2012 | Ayala Vazquez | H01Q 1/243 343/702 |
| 2012/0262343 | A1 | 10/2012 | Radojkovic | |
| 2013/0050046 | A1* | 2/2013 | Jarvis | H01Q 1/243 343/852 |

FOREIGN PATENT DOCUMENTS

| | | |
|---|---|---|
| TW | 201225547 | 6/2012 |
| TW | 201246685 | 11/2012 |
| TW | 201251202 | 12/2012 |
| WO | 2009134788 | 11/2009 |

OTHER PUBLICATIONS

Zhu et al., U.S. Appl. No. 13/402,831, filed Feb. 22, 2012.
Schlub et al., U.S. Appl. No. 13/420,278, filed Mar. 14, 2012.

* cited by examiner

TUNABLE MULTIBAND ANTENNA WITH PASSIVE AND ACTIVE CIRCUITRY

BACKGROUND

This relates generally to electronic devices, and, more particularly, to antennas in electronic devices.

Electronic devices such as portable computers and handheld electronic devices are often provided with wireless communications capabilities. For example, electronic devices may have wireless communications circuitry to communicate using cellular telephone bands and to support communications with satellite navigation systems and wireless local area networks.

It can be difficult to incorporate antennas and other electrical components successfully into an electronic device. Some electronic devices are manufactured with small form factors, so space for components is limited. In many electronic devices, the presence of conductive structures can influence the performance of electronic components, further restricting potential mounting arrangements for components such as antennas.

It would therefore be desirable to be able to provide improved electronic device antennas.

SUMMARY

An electronic device may have an antenna. Antenna structures for the antenna may be formed from patterned metal structures on a dielectric carrier. The dielectric carrier may be a plastic carrier having a shape with sides that create a three-dimensional layout for the antenna structures.

The antenna may be configured to provide coverage in wireless communications bands such as a low frequency communications band and a high frequency communications band. The antenna may have an antenna ground formed from structures such as conductive electronic device housing structures and an antenna resonating element such as an inverted-F antenna resonating element formed from the patterned metal structures on the plastic carrier.

The antenna resonating element may have a high band arm that contributes to a first high band resonance in the high band and may have a low band arm that gives rise to a low band resonance in the low band. A passive filter that is coupled between first and second portions of the low band arm in the antenna resonating element may be configured to exhibit a short circuit impedance at frequencies associated with a second high band resonance in the high band. The short circuit forms a bypass path that shorts together the first and second portions at frequencies in the second high band resonance. In this configuration, the first and second portions of the antenna resonating element form an antenna structure that contributes to the second high band resonance in the high band.

The low band resonance may be tuned using a tunable component. The tunable component may be a tunable inductor that is actively tuned during operation of the antenna and electronic device. The tunable inductor may be coupled between the second portion of the antenna resonating element and the antenna ground. Adjustments to the tunable inductor may be used to tune the low band resonance so that the entire low band is covered by the antenna.

Further features of the invention, its nature and various advantages will be more apparent from the accompanying drawings and the following detailed description of the preferred embodiments.

DETAILED DESCRIPTION

Figure 1:
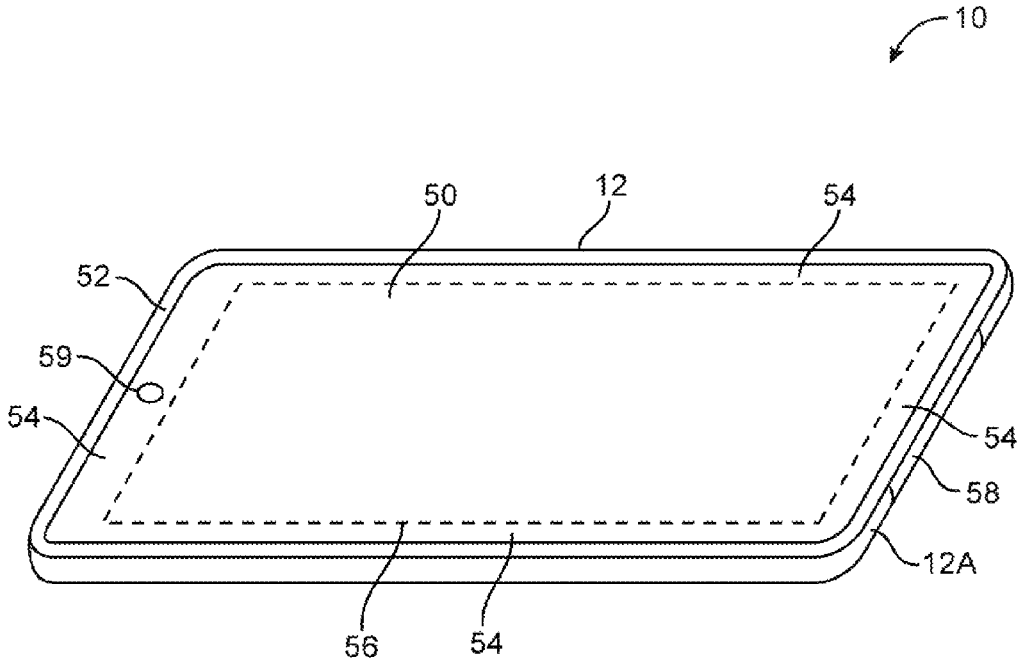
FIG. 1 is a front perspective view of an illustrative electronic device of the type that may be provided with antenna structures in accordance with an embodiment of the present invention.

Electronic devices may be provided with antennas, and other electronic components. An illustrative electronic device in which electronic components such as antenna structures may be used is shown in FIG. 1. As shown in FIG. 1, device 10 may have a display such as display 50. Display 50 may be mounted on a front (top) surface of device 10 or may be mounted elsewhere in device 10. Device 10 may have a housing such as housing 12. Housing 12 may have curved, angled, or vertical sidewall portions that form the edges of device 10 and a relatively planar portion that forms the rear surface of device 10 (as an example). Housing 12 may also have other shapes, if desired.

Housing 12 may be formed from conductive materials such as metal (e.g., aluminum, stainless steel, etc.), carbonfiber composite material or other fiber-based composites, glass, ceramic, plastic, or other materials. A radio-frequency-transparent window such as window 58 may be formed in housing 12 (e.g., in a configuration in which the rest of housing 12 is formed from conductive structures). Window 58 may be formed from plastic, glass, ceramic, or other dielectric material. Antenna structures, and, if desired, proximity sensor structures for use in determining whether external objects are present in the vicinity of the antenna structures may be formed in the vicinity of window 58. If desired, antenna structures and proximity sensor structures may be mounted behind a dielectric portion of housing 12 (e.g., in a configuration in which housing 12 is formed from plastic or other dielectric material).

Device 10 may have user input-output devices such as button 59. Display 50 may be a touch screen display that is used in gathering user touch input. The surface of display 50 may be covered using a display cover layer such as a planar cover glass member or a clear layer of plastic. The central portion of display 50 (shown as region 56 in FIG. 1) may be an active region that displays images and that is sensitive to touch input. Peripheral portions of display 50 such as region 54 may form an inactive region that is free from touch sensor electrodes and that does not display images.

An opaque masking layer such as opaque ink or plastic may be placed on the underside of display 50 in peripheral region 54 (e.g., on the underside of the cover glass). This layer may be transparent to radio-frequency signals. The conductive touch sensor electrodes and display pixel structures and other conductive structures in region 56 tend to block radio-frequency signals. However, radio-frequency signals may pass through the display cover layer (e.g., through a cover glass layer) and opaque masking layer in inactive display region 54 (as an example). Radio-frequency signals may also pass through antenna window 58 or dielectric housing walls in a housing formed from dielectric material. Lower-frequency electromagnetic fields may also pass through window 58 or other dielectric housing structures, so capacitance measurements for a proximity sensor may be made through antenna window 58 or other dielectric housing structures, if desired.

With one suitable arrangement, housing 12 may be formed from a metal such as aluminum. Portions of housing 12 in the vicinity of antenna window 58 may be used as antenna ground. Antenna window 58 may be formed from a dielectric material such as polycarbonate (PC), acrylonitrile butadiene styrene (ABS), a PC/ABS blend, or other plastics (as examples). Window 58 may be attached to housing 12 using adhesive, fasteners, or other suitable attachment mechanisms. To ensure that device 10 has an attractive appearance, it may be desirable to form window 58 so that the exterior surfaces of window 58 conform to the edge profile exhibited by housing 12 in other portions of device 10. For example, if housing 12 has straight edges 12A and a flat bottom surface, window 58 may be formed with a right-angle bend and vertical sidewalls. If housing 12 has curved edges 12A, window 58 may have a similarly curved exterior surface along the edge of device 10.

Figure 2:
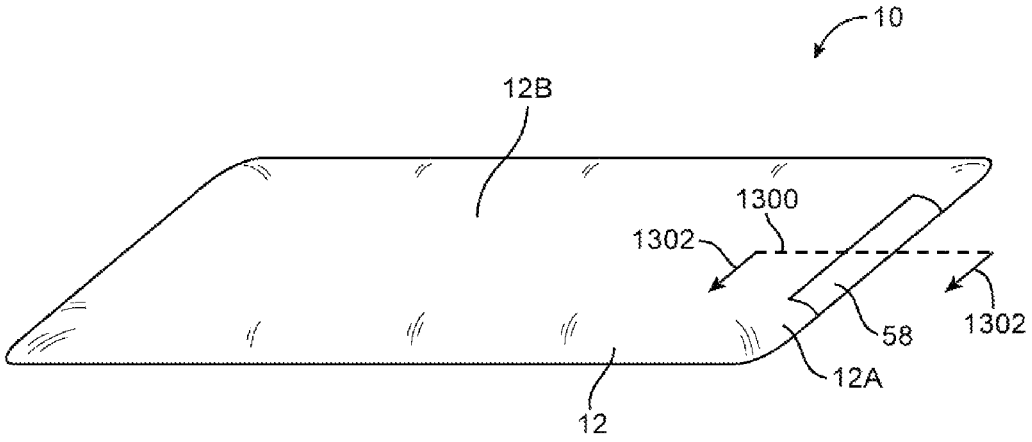
FIG. 2 is a rear perspective view of an illustrative electronic device such as the electronic device of FIG. 1 in accordance with an embodiment of the present invention.

FIG. 2 is a rear perspective view of device 10 of FIG. 1 showing how device 10 may have a relatively planar rear surface 12B and showing how antenna window 58 may be rectangular in shape with curved portions that match the shape of curved housing edges 12A. Antenna window 58 may also have planar walls, if desired.

Figure 3:
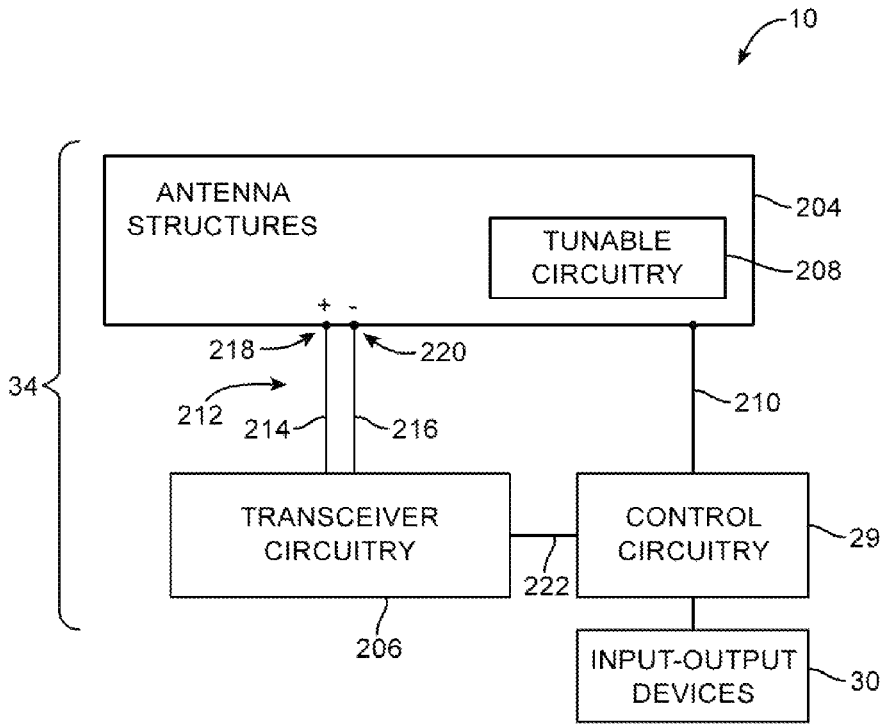
FIG. 3 is a diagram of antenna structures and associated circuitry in an electronic device in accordance with an embodiment of the present invention.

A schematic diagram of an illustrative configuration that may be used for electronic device 10 is shown in FIG. 3. As shown in FIG. 3, electronic device 10 may include control circuitry 29. Control circuitry 29 may include storage and processing circuitry for controlling the operation of device 10. Control circuitry 29 may, for example, include storage such as hard disk drive storage, nonvolatile memory (e.g., flash memory or other electrically-programmable-read-only memory configured to form a solid state drive), volatile memory (e.g., static or dynamic random-access-memory), etc. Control circuitry 29 may include processing circuitry based on one or more microprocessors, microcontrollers, digital signal processors, baseband processors, power management units, audio codec chips, application specific integrated circuits, etc.

Control circuitry 29 may be used to run software on device 10, such as operating system software and application software. Using this software, control circuitry 29 may, for example, transmit and receive wireless data, tune antennas to cover communications bands of interest, and perform other functions related to the operation of device 10.

Input-output devices 30 may be used to allow data to be supplied to device 10 and to allow data to be provided from device 10 to external devices. Input-output circuitry 30 may include communications circuitry such as wired communications circuitry. Device 10 may also use wireless circuitry such as transceiver circuitry 206 and antenna structures 204 to communicate over one or more wireless communications bands.

Input-output devices 30 may also include input-output components with which a user can control the operation of device 10. A user may, for example, supply commands through input-output devices 30 and may receive status information and other output from device 10 using the output resources of input-output devices 30.

Input-output devices 30 may include sensors and status indicators such as an ambient light sensor, a proximity sensor, a temperature sensor, a pressure sensor, a magnetic sensor, an accelerometer, and light-emitting diodes and other components for gathering information about the environment in which device 10 is operating and providing information to a user of device 10 about the status of device 10. Audio components in devices 30 may include speakers and tone generators for presenting sound to a user of device 10 and microphones for gathering user audio input. Devices 30 may include one or more displays such as display 50 of FIG. 1. Displays may be used to present images for a user such as text, video, and still images. Sensors in devices 30 may include a touch sensor array that is formed as one of the layers in display 14. During operation, user input may be gathered using buttons and other input-output components in devices 30 such as touch pad sensors, buttons, joysticks, click wheels, scrolling wheels, touch sensors such as a touch sensor array in a touch screen display or a touch pad, key pads, keyboards, vibrators, cameras, and other input-output components.

Wireless communications circuitry 34 may include radio-frequency (RF) transceiver circuitry such as transceiver circuitry 206 that is formed from one or more integrated circuits, power amplifier circuitry, low-noise input amplifiers, passive RF components, one or more antennas such as antenna structures 204, and other circuitry for handling RF wireless signals. Wireless signals can also be sent using light (e.g., using infrared communications).

Wireless communications circuitry 34 may include radio-frequency transceiver circuits for handling multiple radio-frequency communications bands. For example, circuitry 34 may include transceiver circuitry 206 for handling cellular telephone communications, wireless local area network signals, and satellite navigation system signals such as signals at 1575 MHz from satellites associated with the Global Positioning System. Transceiver circuitry 206 may handle 2.4 GHz and 5 GHz bands for WiFi® (IEEE 802.11) communications or other wireless local area network communications and may handle the 2.4 GHz Bluetooth® communications band. Circuitry 206 may use cellular telephone transceiver circuitry 38 for handling wireless communications in cellular telephone bands such as the bands in the range of 700 MHz to 2.7 GHz (as examples).

Wireless communications circuitry 34 can include circuitry for other short-range and long-range wireless links if desired. For example, wireless communications circuitry 34 may include wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles. Wireless communications circuitry 34 may also include circuitry for handing near field communications.

Wireless communications circuitry 34 may include antenna structures 204. Antenna structures 204 may include one or more antennas. Antenna structures 204 may include inverted-F antennas, patch antennas, loop antennas, monopoles, dipoles, single-band antennas, dual-band antennas, antennas that cover more than two bands, or other suitable antennas. Configurations in which at least one antenna in device 10 is formed from an inverted-F antenna structure such as a dual band inverted-F antenna are sometimes described herein as an example.

To provide antenna structures 204 with the ability to cover communications frequencies of interest, antenna structures 204 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna).

If desired, antenna structures 204 may be provided with adjustable circuits such as tunable circuitry 208. Tunable circuitry 208 may be controlled by control signals from control circuitry 29. For example, control circuitry 29 may supply control signals to tunable circuitry 208 via control path 210 during operation of device 10 whenever it is desired to tune antenna structures 204 to cover a desired communications band. Path 222 may be used to convey data between control circuitry 29 and wireless communications circuitry 34 (e.g., when transmitting wireless data or when receiving and processing wireless data).

Passive filter circuitry in antenna structures 204 may help antenna structures 204 exhibit antenna resonances in communications bands of interest (e.g., passive filter circuitry in antenna structures 204 may short together different portions of antenna structures 204 and/or may form open circuits or pathways of other impedances between different portions of antenna structures 204 to ensure that desired antenna resonances are produced).

Transceiver circuitry 206 may be coupled to antenna structures 204 by signal paths such as signal path 212. Signal path 212 may include one or more transmission lines. As an example, signal path 212 of FIG. 3 may be a transmission line having a positive signal conductor such as line 214 and a ground signal conductor such as line 216. Lines 214 and 216 may form parts of a coaxial cable or a microstrip transmission line (as examples). A matching network formed from components such as inductors, resistors, and capacitors may be used in matching the impedance of antenna structures 204 to the impedance of transmission line 212. Matching network components may be provided as discrete components (e.g., surface mount technology components) or may be formed from housing structures, printed circuit board structures, traces on plastic supports, etc. Components such as these may also be used in forming passive filter circuitry in antenna structures 204 and tunable circuitry 208 in antenna structures 204.

Transmission line 212 may be coupled to antenna feed structures associated with antenna structures 204. As an example, antenna structures 204 may form an inverted-F antenna having an antenna feed with a positive antenna feed terminal such as terminal 218 and a ground antenna feed terminal such as ground antenna feed terminal 220. Positive transmission line conductor 214 may be coupled to positive antenna feed terminal 218 and ground transmission line conductor 216 may be coupled to ground antenna feed terminal 220. Other types of antenna feed arrangements may be used if desired. The illustrative feeding configuration of FIG. 3 is merely illustrative.

Tunable circuitry 208 may be formed from one or more tunable circuits such as circuits based on capacitors, resistors, inductors, and switches. Tunable circuitry 208 may be implemented using discrete components mounted to a printed circuit such as a rigid printed circuit board (e.g., a printed circuit board formed from glass-filled epoxy) or a flexible printed circuit formed from a sheet of polyimide or a layer of other flexible polymer, a plastic carrier, a glass carrier, a ceramic carrier, or other dielectric substrate. As an example, tunable circuitry 208 may be coupled to a dielectric carrier of the type that may be used in supporting antenna resonating element traces for antenna structures 204 (FIG. 3). Filter circuitry in antenna structures 204 such as passive filter circuitry may also be formed using these types of arrangement.

FIGS. 4, 5, 6, 7, 8, 9, and 10 are diagrams of illustrative tunable circuits of the types that may be used in implementing some or all of tunable antenna circuitry 208 of FIG. 3. Tunable antenna circuits 208 may have two or more terminals. For example, tunable antenna components 208 may each have respective first and second terminals 228 and 230. Terminals 228 and 230 may be coupled to conductive structures at different respective locations within antenna structures 204. During operation of device 10, control circuitry 29 may issue commands on path 210 to adjust switches, variable components, and other adjustable circuitry in tunable circuitry 208, thereby tuning antenna structures 204.

Figure 4:
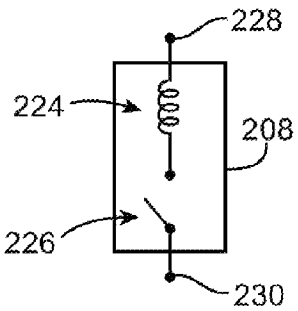
FIG. 4 is a circuit diagram of an illustrative tunable component based on a series-connected inductor and switch in accordance with an embodiment of the present invention.

As shown FIG. 4, tunable circuitry 208 may include a series-coupled inductor and switch such as inductor 224 and switch 226. Inductor 224 and switch 226 may be connected in series between terminals 228 and 230. Switch 226 may be closed to switch inductor 224 into use and may be opened when it is desired to remove inductor 224 from use in antenna structures 204. There is one inductor 224 in tunable circuitry 208, but two or more inductors may be switched into and out of use by switch 226 in component 208 if desired.

Figure 5:
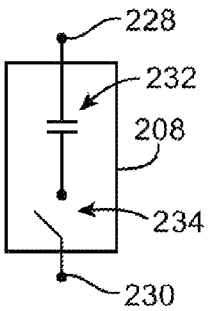
FIG. 5 is a circuit diagram of an illustrative tunable component based on a series-connected capacitor and switch in accordance with an embodiment of the present invention.

As shown in FIG. 5, tunable circuitry 208 may include a series-coupled capacitor and switch such as capacitor 232 and switch 234. Capacitor 232 and switch 234 may be connected in series between terminals 228 and 230. Switch 234 may be closed to switch capacitor 232 into use and may be opened when it is desired to remove capacitor 232 from use in antenna structures 204.

Figure 7:
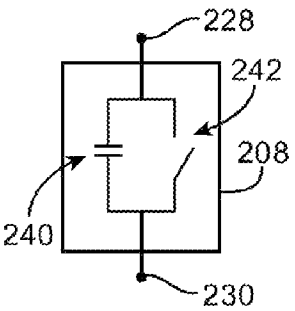
FIG. 7 is a circuit diagram of an illustrative tunable component based on a parallel capacitor and bypass switch in accordance with an embodiment of the present invention.
Figure 6:
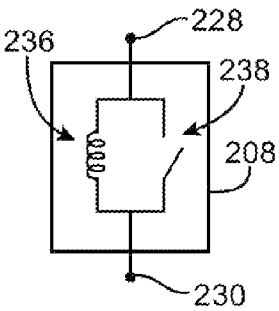
FIG. 6 is a circuit diagram of an illustrative tunable component based on a parallel inductor and bypass switch in accordance with an embodiment of the present invention.

Tunable components 208 may, if desired, use bypassable components. As shown in FIG. 6, for example, tunable circuit 208 may include an inductor such as inductor 236 that is coupled in parallel with a switch such as switch 238 between terminals 228 and 230. Switch 238 may be closed when it is desired to bypass inductor 236. As shown in FIG. 7, tunable circuit 208 may include a capacitor such as capacitor 240 that is coupled in parallel with a switch such as switch 242 between terminals 228 and 230. Switch 242 may be closed when it is desired to bypass capacitor 240.

Figure 9:
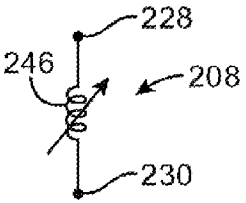
FIG. 9 is a circuit diagram of an illustrative tunable component based on a variable inductor in accordance with an embodiment of the present invention.
Figure 8:
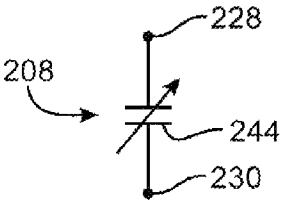
FIG. 8 is a circuit diagram of an illustrative tunable component based on a variable capacitor in accordance with an embodiment of the present invention.

Variable components such as varactors, variable inductors, and variable resistors may be used in tunable circuitry 208 to provide continuously adjustable component values. FIG. 8 is a diagram of tunable circuitry 208 in a configuration based on varactor 244. FIG. 9 shows how variable inductor 246 may be used to form tunable circuitry 208. Variable components may, if desired, be coupled in series or parallel with switches.

Switches in tunable circuitry 208 may be based on diodes, transistors, microelectromechanical systems (MEMS) devices, or other switching circuitry.

Figure 10:
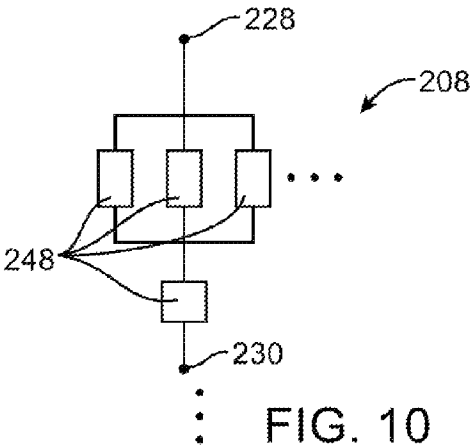
FIG. 10 is a circuit diagram of an illustrative tunable component based on multiple components such as fixed and tunable components coupled in series and in parallel in accordance with an embodiment of the present invention.

As shown in FIG. 10, tunable circuitry 208 may include multiple components 248. Components 248 may be coupled in series and/or in parallel between terminals 228 and 230. Each component 248 in FIG. 10 may be implemented using one or more of the circuits of FIGS. 4, 5, 6, 7, 8, and 9, switches, variable components, bypassable components, or other tunable components. As an example, tunable component 208 may be implemented using two or more or three or more adjustable inductors (e.g., inductors implemented using circuit 208 of FIG. 4, circuit 208 of FIG. 6, or circuit 208 of FIG. 9 that are coupled in parallel between terminals 228 and 230). Multiple switches may be used in switching a desired inductor (or other component) into use or switching circuitry having one or more switches with multiple positions may be used in switching a desired inductor or inductors (or other components) into use.

Figure 11:
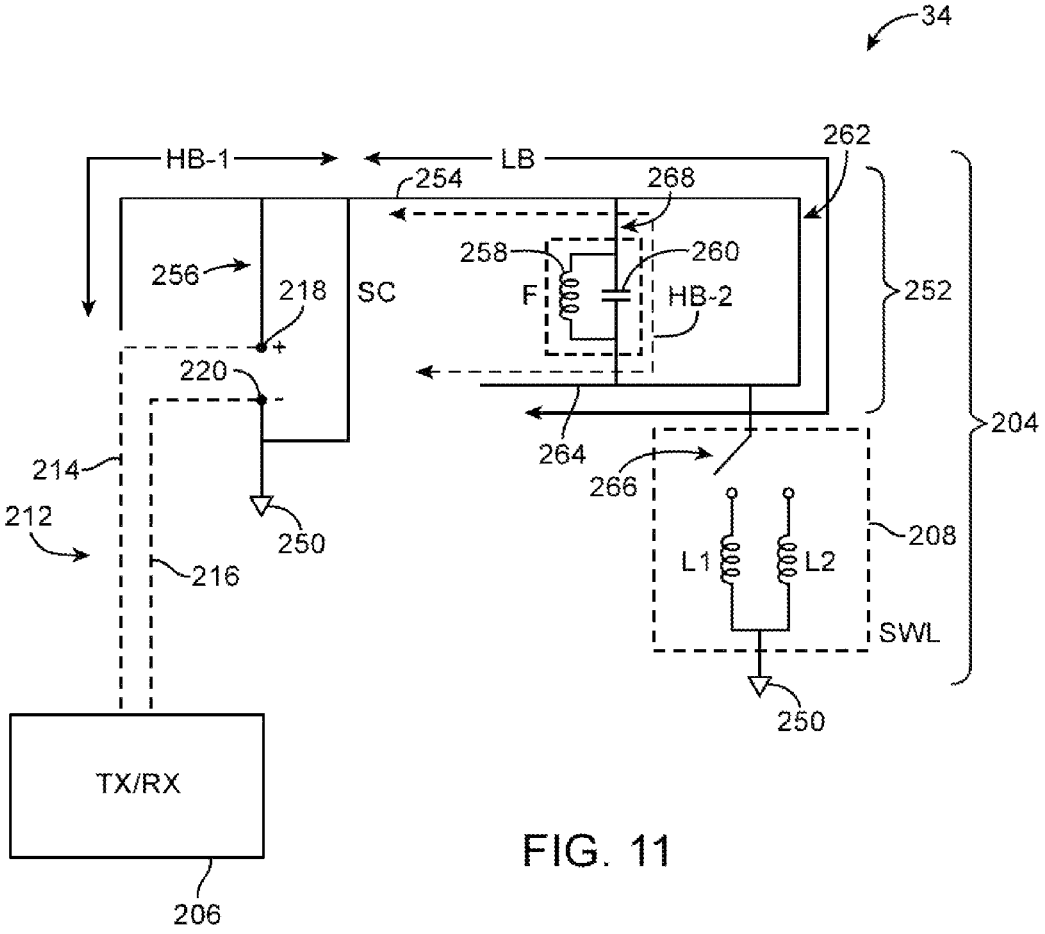
FIG. 11 is a diagram of an antenna in accordance with an embodiment of the present invention.

FIG. 11 is a diagram of an illustrative antenna configuration that may be used for antenna structures 204 in device 10. In the FIG. 11 example, antenna structures 204 are implemented using a dual-arm inverted-F antenna (antenna 204) having antenna resonating element 252 and antenna ground 250. Antenna ground 250 may be formed from metal electronic device housing structures 12, may be formed from patterned metal traces on a dielectric support structure (e.g., a plastic carrier, printed circuit substrate, glass, ceramic, etc.), or may be formed from other conductive structures in device 10. Antenna resonating element 252 may be formed from patterned metal traces on a plastic carrier, may be formed from patterned metal traces on a flexible printed circuit (e.g., a printed circuit formed from a layer of polyimide or a sheet of other flexible polymer), may be formed from patterned metal traces on a rigid printed circuit board substrate (e.g. a printed circuit board substrate formed from fiberglass-filled epoxy), may be formed from stamped metal foil or wires, or may be formed from other conductive structures.

Antenna 204 has main resonating element structure 254. Main resonating element structure 254 may be formed from an elongated conductive structure (e.g., a strip of metal). Antenna feed path 256 and short circuit path SC may be coupled in parallel between main resonating element structures 254 and ground 250.

Main resonating element structure 254 may have multiple arms. For example, structure 254 may have high band arm HB-1. High band arm HB-1 may be associated with a first high band resonance contribution to a high-frequency communications band. Structure 254 may also have low band arm LB for supporting an antenna resonance at a lower frequency than the first high band resonance frequency (i.e., in a low frequency band LB).

Main resonating element structure 254 (i.e., low band arm LB) may have a bend such as bend 262. The bent portion of main resonating element 252 couples portion 254 to tip portion 264, so that tip portion 264 of resonating element 252 runs parallel to main resonating element portion 254 of resonating element 252. Tip segment 264 may lie between main portion (segment) 254 and antenna ground 250.

Tunable element 208 may be coupled between tip segment 264 of antenna resonating element 252 and antenna ground 250. During operation of antenna 204, tunable element 208 may be adjusted to switch inductor L1 (having a first inductance value) or inductor L2 (having a second inductance value) into use. By adjusting whether inductor L1 or inductor L2 couples antenna segment 264 to antenna ground 250 or whether both inductors L1 and L2 are switched out of use so that an infinite impedance (open circuit) is formed by tunable element 208 so that segment 264 is isolated from ground 250, control circuitry 29 can adjust low band performance for antenna 204 (e.g., control circuitry 29 can make adjustments to tunable element 208 to tune a low band antenna resonance for antenna 204).

The main segment of antenna resonating element 252 may be coupled to folded tip segment 264 of antenna resonating element 252 using filter circuitry F. Filter F may include components such as inductor 258 and capacitor 260. The components of filter F such as inductor 258 and capacitor 260 may form a resonant circuit having a relatively low impedance (i.e., a short circuit impedance) at frequencies associated with a second high band resonance HB-2 in a high band HB and having a relatively high impedance (open circuit impedance) at other frequencies such as those associated with operation in low band LB.

At high band operating frequencies, filter F may form a short circuit that shorts main portion (segment) 254 of antenna resonating element 252 to tip portion 264 of antenna resonating element 252, thereby allowing currents in antenna 204 to flow within high band path HB-2 of resonating element 252, bypassing the rest of low band arm LB near bend 262. Filter F therefore allows path 268 to serve as a bypass path in antenna resonating element 252 at high frequencies HB-2. At low frequencies associated with operation of antenna 204 in low band LB, currents in antenna 204 may flow within low band arm LB without passing through bypass path 268.

The configuration of FIG. 11 in which part of the antenna resonating element is bridged with a passive filter and in which a tip portion of the antenna resonating element is coupled to ground by a tunable component such as an adjustable inductor allows a dual-arm inverted-F antenna to exhibit three antenna resonances. Antenna resonance HB-1 forms a first contribution to high band resonance HB and is associated with the current path for high band arm HB-1. A second high band resonance HB-2 forms a second contribution to high band resonance HB and is associate with the current path through filter F (i.e., bypass path 268). Resonances HB-1 and HB-2 may overlap to form a combined overall high band resonance HB for antenna 204.

A low band resonance, which is tuned by adjustment of the inductance between resonating element 252 and antenna ground 250, may be associated with low band path LB.

Figure 12:
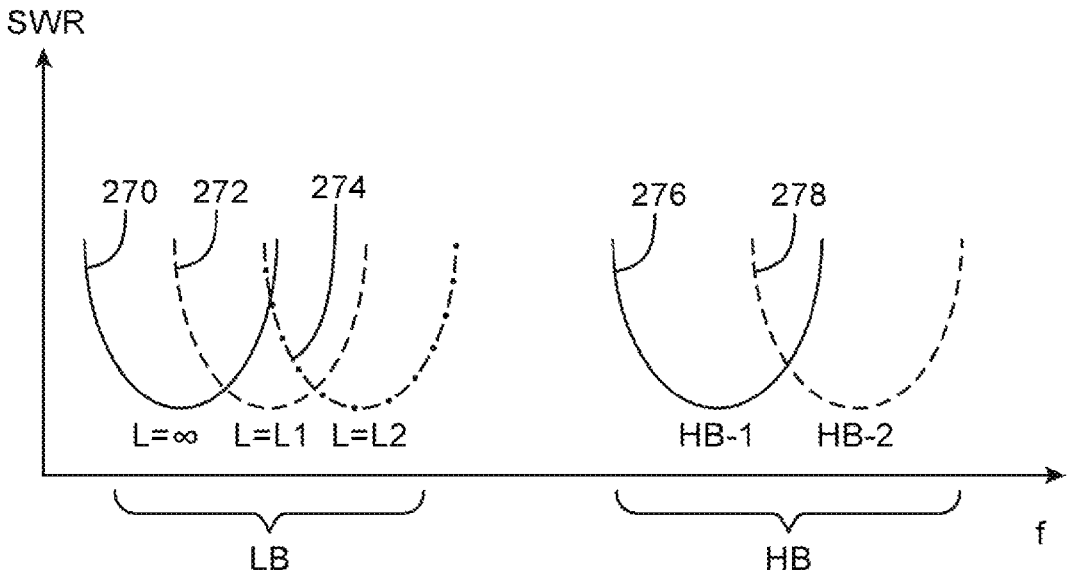
FIG. 12 is a graph in which antenna performance (standing wave ratio) has been plotted as a function of frequency in low and high communications bands in accordance with an embodiment of the present invention.

FIG. 12 is a graph in which antenna performance (i.e., standing wave ratio SWR) has been plotted as a function of frequency f for an antenna such as antenna 204 of FIG. 11.

As shown in FIG. 12, antenna 204 may exhibit coverage in lower communications band LB and in higher communications band HB. Bands LB and HB may be associated with cellular telephone traffic, wireless local area network traffic, and/or satellite navigation system signals (as examples). For example, low band LB may cover cellular telephone communications at frequencies from 700 MHz to 960 MHz and high band HB may cover cellular telephone communications and/or satellite navigation system signals at frequencies from 1560 MHz to 2170 MHz. Other communications bands may be covered using antenna 204 if desired. The frequency coverage of the graph of FIG. 12 is merely illustrative.

Coverage for high band HB may be achieved using passive filter circuitry to form multiple antenna resonating element paths within antenna 204. For example, resonance 276 may be formed using high band arm HB-1 and resonance 278 may be formed using high band bypass path HB-2 in low band path LB. Coverage across all of low band LB may be achieved by adjusting the inductance of tunable inductor 208 to tune the low band resonance of antenna 204. Antenna 204 may, for example, exhibit antenna resonance 270 when inductor 208 is placed in a first state in which inductors L1 and L2 are switched out of use by switching circuitry 266 of tunable inductor 208. In this first state for tunable inductor 208, tunable inductor 208 may form an open circuit (i.e., the inductance of inductor 208 may effectively be infinite). Antenna 204 may exhibit antenna resonance 272 when inductor 208 is placed in a second state in which inductor L1 is switched into use and may exhibit antenna resonance 274 when inductor 208 is placed in a third state in which inductor 208 is placed in a third state in which inductor L2 is switched into use.

With the arrangement of FIG. 2, low band coverage is achieved using active tuning of tunable element 208 and high band coverage is achieved using passive filter tuning with frequency-dependent filter F. Configurations in which tunable inductor 208 can be adjusted to exhibit a different number of inductances and/or filter circuitry F may be used in forming different numbers of bypass paths may be used if desired. The example of FIGS. 11 and 12 is merely illustrative.

Figure 13:
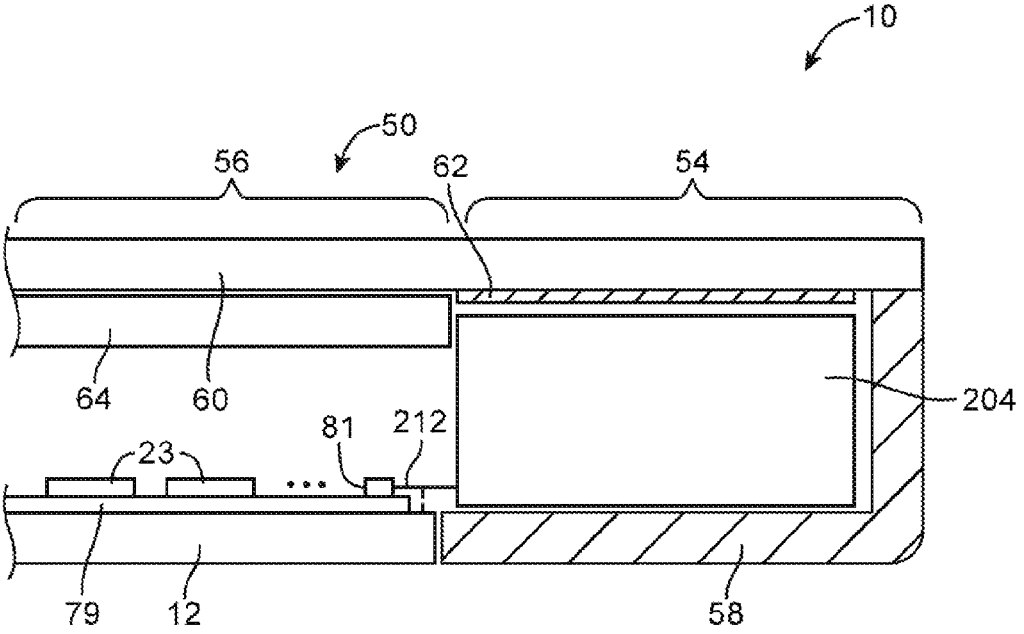
FIG. 13 is a cross-sectional side view of an illustrative electronic device having an antenna in accordance with an embodiment of the present invention.

A cross-sectional view of device 10 taken along line 1300 of FIG. 2 and viewed in direction 1302 is shown in FIG. 13. As shown in FIG. 13, antenna structures 204 may be mounted within device 10 in the vicinity of antenna window 58. Structures 204 may include conductive material that serves as an antenna resonating element for an antenna. The antenna may be fed using transmission line 212. Transmission line 212 may have a positive signal conductor that is coupled to a positive antenna feed terminal such as positive antenna feed terminal 218 of FIG. 3 and a ground signal conductor that is coupled to a ground antenna feed terminal such as ground antenna feed terminal 220 of FIG. 3 (i.e., antenna ground formed from conductive ground traces on a dielectric carrier in antenna structures 204 and/or grounded structures such as grounded portions of housing 12).

The antenna resonating element formed from structures 204 may be based on any suitable antenna resonating element design (e.g., structures 204 may form a patch antenna resonating element, a single arm inverted-F antenna structure, a dual-arm inverted-F antenna structure, other suitable multi-arm or single arm inverted-F antenna structures, a closed and/or open slot antenna structure, a loop antenna structure, a monopole, a dipole, a planar inverted-F antenna structure, a hybrid of any two or more of these designs, etc.). Housing 12 may serve as antenna ground for an antenna formed from structure 204 and/or other conductive structures within device 10 and antenna structures 204 may serve as ground (e.g., conductive components, traces on printed circuits, etc.).

Structures 204 may include patterned conductive structures such as patterned metal structures. The patterned conductive structures may, if desired, be supported by a dielectric carrier. The conductive structures may be formed from a coating, from metal traces on a flexible printed circuit, or from metal traces formed on a plastic carrier using laser-processing techniques or other patterning techniques. Structures 204 may also be formed from stamped metal foil or other metal structures. In configurations for antenna structures 204 that include a dielectric carrier, metal layers may be formed directly on the surface of the dielectric carrier and/or a flexible printed circuit that includes patterned metal traces may be attached to the surface of the dielectric carrier. If desired, conductive material in structures 204 may also form one or more proximity sensor capacitor electrodes.

During operation of the antenna formed from structures 204, radio-frequency antenna signals can be conveyed through dielectric window 58. Radio-frequency antenna signals associated with structures 204 may also be conveyed through a display cover member such as cover layer 60. Display cover layer 60 may be formed from one or more clear layers of glass, plastic, or other materials. Display 50 may have an active region such as region 56 in which cover layer 60 has underlying conductive structure such as display panel module 64. The structures in display panel 64 such as touch sensor electrodes and active display pixel circuitry may be conductive and may therefore attenuate radio-frequency signals. In region 54, however, display 50 may be inactive (i.e., panel 64 may be absent). An opaque masking layer such as plastic or ink 62 may be formed on the underside of transparent cover glass 60 in region 54 to block antenna structures 204 from view by a user of device 10. Opaque material 62 and the dielectric material of cover layer 60 in region 54 may be sufficiently transparent to radio-frequency signals that radio-frequency signals can be conveyed through these structures during operation of device 10.

Device 10 may include one or more internal electrical components such as components 23. Components 23 may include storage and processing circuitry such as microprocessors, digital signal processors, application specific integrated circuits, memory chips, and other control circuitry such as control circuitry 29 of FIG. 3. Components 23 may be mounted on one or more substrates such as substrate 79 (e.g., rigid printed circuit boards such as boards formed from fiberglass-filled epoxy, flexible printed circuits, molded plastic substrates, etc.). Components 23 may include input-output circuitry such as sensor circuitry (e.g., capacitive proximity sensor circuitry), wireless circuitry such as radio-frequency transceiver circuitry 206 of FIG. 3 (e.g., circuitry for cellular telephone communications, wireless local area network communications, satellite navigation system communications, near field communications, and other wireless communications), amplifier circuitry, and other circuits. Connectors such as connector 81 may be used in interconnecting circuitry 23 to communications paths such as transmission line path 212.

Figure 14:
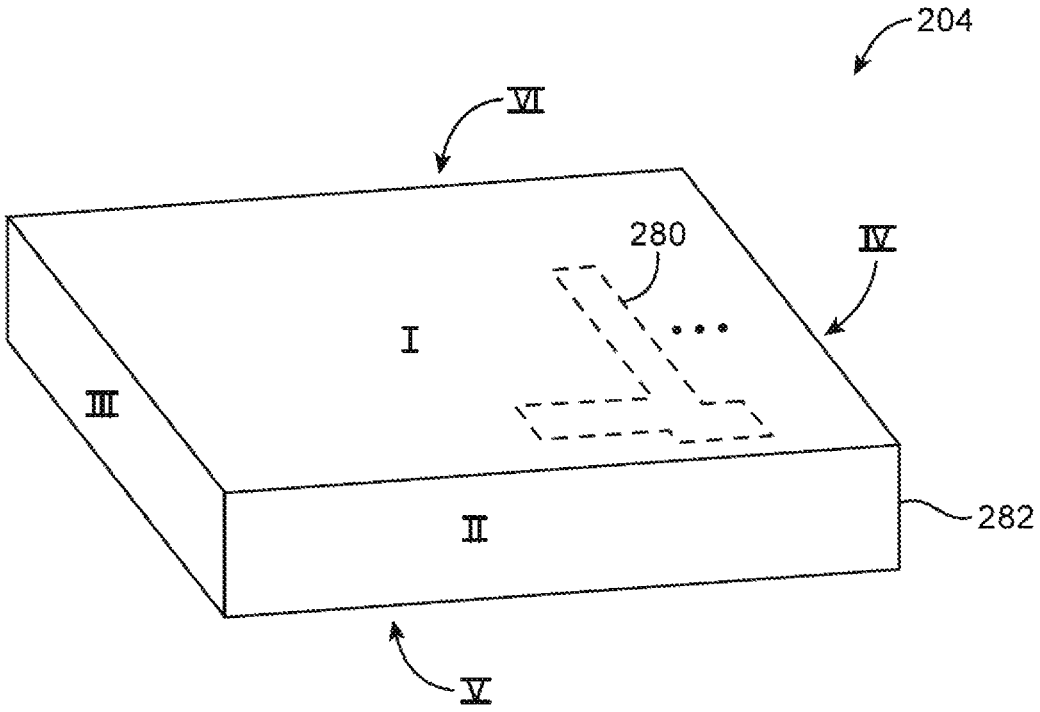
FIG. 14 is a perspective view of an illustrative antenna having a three-dimensional carrier such as a box-shaped carrier with six sides in accordance with an embodiment of the present invention.

FIG. 14 shows how conductive structures for antenna structures 204 may be supported by a dielectric carrier. As shown in FIG. 14, antenna structures 204 may have conductive structures 280 such as metal structures that are supported by dielectric carrier 282. Conductive structures 280 may be metal traces that are formed on the surface of dielectric carrier 282 (e.g., using laser-based deposition techniques, physical vapor deposition techniques, electrochemical deposition, etc.), may be metal traces on a flexible printed circuit that is mounted on dielectric carrier 282, may be other metal structures supported by carrier 282 (e.g., patterned metal foil), or may be other conductive structures.

Dielectric carrier 282 may be formed from a dielectric material such as glass, ceramic, or plastic. As an example, dielectric carrier 282 may be formed from plastic parts that are molded and/or machined into a desired shape such as the illustrative rectangular prism shape (rectangular box shape) of FIG. 14. If desired, other dielectric carrier shapes (e.g., box or prism shapes with different numbers of sides or other three-dimensional carrier shapes) may be used for antenna structures 204. The example of FIG. 14 is merely illustrative.

As shown in the FIG. 14 configuration, dielectric carrier 268 may have six sides: side I, side II, side III, side IV, side V, and side VI. Metal traces 280 may cover at least some of each of the six sides of carrier 268 or may cover a subset of the sides of carrier 268 so as to allow antenna structures 204 to efficiently use a limited volume within device 10 to form an antenna with resonances at desired frequencies. Openings in metal traces 280 (e.g., slot-shaped openings, etc.) may be used to help control the flow of currents in metal traces 280 and thereby adjust antenna performance. If desired, carrier 282 may have other numbers of sides (e.g., four sides, five sides, more than two sides, fewer than six sides, four or more sides, five or more sides, shapes with curved surfaces that take the place of one or more of the sides of FIG. 14, etc.). The use of six planar sides for carrier 282 is merely illustrative.

Figure 15:
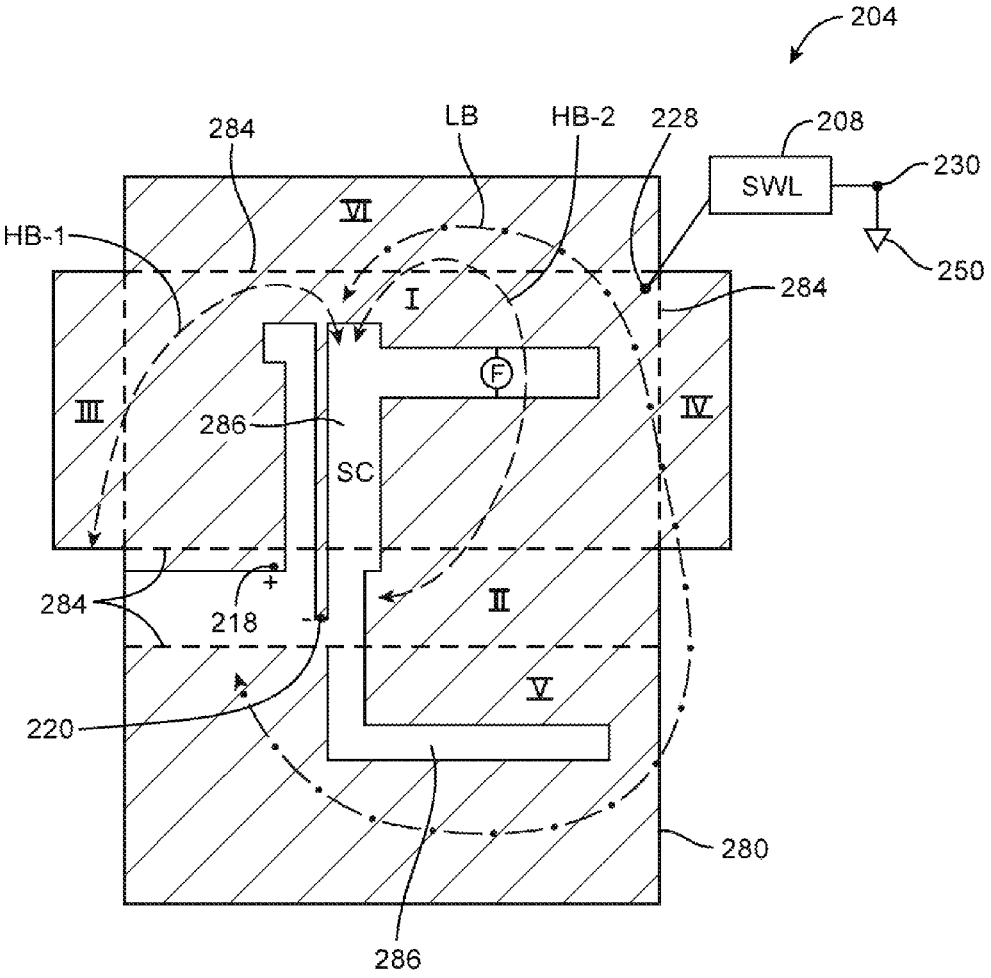
FIG. 15 is a top view of unwrapped metal structures from the illustrative antenna of FIG. 14 in accordance with an embodiment of the present invention.

FIG. 15 is a diagram showing an illustrative pattern that may be used for metal structures 280. In the arrangement of FIG. 15, structures 280 have been unwrapped from carrier 282 and laid out flat. Dashed lines 284 represent fold lines (i.e., axes along which structures 280 are folded when wrapped around carrier 282 to form antenna structures 204 of FIG. 14). Openings such as openings 286 are used to form a desired pattern for conductive structures 280. Metal strip portion SC of metal structures 270 may serve as short circuit SC of FIG. 11. Dashed line path HB-1 in metal structures 280 shows how portions of metal structures 280 may serve as high band resonating element arm HB-1 of FIG. 11. Dashed line path HB-2 though filter F shows how portions of metal structures 280 and filter F may serve as high band resonating element path HB-2 of FIG. 11. Dashed line LB in metal structures 280 show how portions of metal structures 280 may also serve as low band resonating element arm LB of FIG. 11. Transmission line 212 (FIG. 3) may be coupled to antenna feed terminals 218 and 220. Other patterns may be used for metal structures 280 if desired. The configuration of FIG. 15 in which metal structures 280 form a three-dimensional wrapped metal sheet surrounding carrier 282 of FIG. 14 to implement an inverted-F antenna of the type shown in FIG. 11 is merely illustrative.

To provide antenna structures 204 with the ability to be tuned to cover different desired communications bands during use, antenna structures 204 may be provided with passive filter circuitry F and active tunable circuitry 208. As an example, terminal 228 of tunable circuitry 208 may be coupled to a portion of conductive structures 280 and terminal 230 of tunable circuitry 208 may be coupled to antenna ground 250. In general, the locations at which terminals 228 and 230 are coupled to antenna 204 may be positioned at any points on metal structures 280 that provide a desired amount of antenna response tuning. The illustrative coupling locations for terminals 228 and 230 are merely illustrative.

If desired, dielectric carrier 282 may be formed from a structure that contains one or more cavities (i.e., dielectric carrier 282 may be hollow). Cavities in carrier 282 may be filled with air, porous material with a low dielectric constant, foam, or other materials. Dielectric carrier 282 may have a body that is covered with a lid or other configurations.

Conductive structures 280 may be formed from patterned metal traces formed directly on the surface of dielectric carrier 282. The pattern of metal used in forming structures 280 may be created by photolithographic patterning, using laser direct structuring (LDS) techniques in which applied laser light (or other activation mechanism) is used to selectively activate desired surface regions on a plastic carrier that are subsequently electroplated or otherwise coated with metal to form patterned metal structures 280, or molded interconnect device (MID) techniques in which multiple shots of plastic (some metal-attracting and some metal-repelling) are used to create desired metal patterns 280 following electroplating or other metal coating operations.

If desired, a flexible printed circuit may be provided with metal traces such as metal traces 280. Adhesive, solder, welds, screws, or other fastening arrangements may be used to attach flexible printed circuit to dielectric carrier 282.

The foregoing is merely illustrative of the principles of this invention and various modifications can be made by those skilled in the art without departing from the scope and spirit of the invention.

What is claimed is:

1. An antenna, comprising:

an inverted-F antenna resonating element having a low band arm and a high band arm, wherein the high band arm has a bend and the low band arm has first, second, and third portions, the first portion extends parallel to the second portion, and the third portion extends between the first and second portions and perpendicular to the first and second portions;

an antenna ground, wherein the low band arm and the antenna ground are configured to resonate in a low communications band and the high band arm and the antenna ground are configured to resonate in a first high communications band;

an antenna feed having a first feed terminal coupled to the inverted-F antenna resonating element and a second feed terminal coupled to the antenna ground;

a short circuit path coupled between the inverted-F antenna resonating element and the antenna ground, wherein the first portion of the low band arm and the high band arm extend from opposing sides of the short circuit path;

a filter coupled between the first portion of the low band arm and the second portion of the low band arm, wherein the filter is configured to form a short circuit between the first and second portions of the low band arm in a second high communications band, the short circuit forms a path length that is shorter than the low band arm, and the filter is configured to form an open circuit in the low communications band; and a tunable component coupled between the second portion of the low band arm and the antenna ground, wherein the tunable component is configured tune the low communications band at which the low band arm and the antenna ground resonate.

2. The antenna defined in claim 1 wherein the tunable component comprises an adjustable inductor.

3. The antenna defined in claim 2 wherein the adjustable inductor comprises at least one inductor and switching circuitry that selectively switches the inductor into and out of use.

4. The antenna defined in claim 2 wherein the adjustable inductor comprises switching circuitry and first and second inductors and wherein the switching circuitry is configured to selectively place the adjustable inductor in a first state in which the first inductor is switched into use, a second state in which the second inductor is switched into use, and a third state in which the first and second inductors are switched out of use.

5. The antenna defined in claim 4 in which the filter comprises a passive filter.

6. The antenna defined in claim 5 in which the filter comprises an inductor and capacitor coupled in parallel.

7. The antenna defined in claim 1 wherein the filter comprises a passive filter that includes at least one inductor.

8. The antenna defined in claim 7 wherein the filter further includes at least one capacitor.

9. The antenna defined in claim 1 wherein the low band arm of the inverted-F antenna resonating element has a first bend between the first and third portions and a second bend between the third and second portions.

10. The antenna defined in claim 1 wherein the inverted-F antenna resonating element comprises metal traces on a dielectric carrier.

11. The antenna defined in claim 1 wherein the first and second high communications bands are configured to handle cellular telephone communications.

12. An electronic device, comprising:

a metal housing having an opening;

an antenna window in the opening;

an antenna ground formed at least partly from the metal housing;

a plastic carrier adjacent to the opening;

an antenna resonating element formed from metal structures on the plastic carrier;

a short circuit path coupled between the antenna resonating element and the antenna ground;

a first antenna feed terminal coupled to the antenna ground;

a second antenna feed terminal coupled to the antenna resonating element, wherein the antenna resonating element has a first arm and a second arm, the first arm and the antenna ground are configured to exhibit a low band antenna resonance, the second arm and the antenna ground are configured to exhibit a high band antenna resonance; and a passive filter that bridges an opening between a first portion of the first arm and a second portion of the first arm, wherein the first portion of the first arm extends parallel to the second portion of the first arm, the first and second portions of the first arm are coupled together by a third portion of the first arm that extends perpendicular to the first and second portions, the second arm and the first portion of the first arm extend from opposing sides of the short circuit path, and the passive filter forms a path length that is shorter than the first arm.

13. The electronic device defined in claim 12 further comprising a tunable component coupled between the second portion of first arm and the antenna ground.

14. The electronic device defined in claim 13 wherein the tunable component comprises an adjustable inductor and wherein the electronic device further comprises control circuitry that controls the adjustable inductor to tune the low band antenna resonance.

15. The electronic device defined in a claim 14 wherein the passive filter comprises components configured to exhibit a short circuit impedance at a frequency within the high band resonance.

16. The electronic device defined in claim 15 further comprising:

a display cover layer having a portion that overlaps that antenna resonating element, wherein the antenna resonating element is configured to receive radio-frequency signals through the antenna window and the portion of the display cover layer that overlaps the antenna resonating element.

17. The electronic device defined in claim 12 wherein the antenna comprises an inverted-F antenna and wherein the antenna resonating element comprises metal traces on the plastic carrier.

18. An antenna comprising:

an antenna ground;

an antenna resonating element having a first arm and a second arm, wherein the antenna ground and the first arm are configured to resonate in a low frequency band, the antenna ground and the second arm are configured to resonate in a first high frequency band;

an antenna feed having a first feed terminal coupled to the antenna ground and a second feed terminal coupled to the antenna resonating element;

a short circuit path coupled between the antenna ground and the antenna resonating element;

a passive filter coupled between a first portion of the first arm and a second portion of the first arm, wherein the passive filter forms a short circuit that creates a path length that is shorter than the first arm at frequencies in a second high frequency band that is greater than the first high frequency band and forms an open circuit for at least some frequencies other than the frequencies in the second high frequency band; and a dielectric carrier having a planar surface, wherein at least some of the first and second portions of the first arm, the second arm, and the short circuit path are formed from metal traces on the planar surface, and the short circuit path is interposed between the second arm and the second portion of the first arm on the planar surface.

19. The antenna defined in claim 18 wherein the first and second portions of the first arm are coupled by a bent portion of the antenna resonating element and wherein the antenna further comprises an actively tuned tunable component coupled to the second portion.

20. The antenna defined in claim 19 wherein the actively tuned tunable component comprises a tunable inductor having a terminal coupled to the antenna ground and wherein the antenna resonating element comprises an inverted-F antenna resonating element.

21. The antenna defined in claim 18, wherein the first portion extends parallel to the second portion and the first arm comprises a third portion on the planar surface that extends perpendicular to the first and second portions.

22. The antenna defined in claim 18, wherein the dielectric carrier has first, second, third, fourth, fifth, and sixth surfaces, the planar surface is the first surface, the second arm includes metal traces on the first and third surfaces, the first arm includes metal traces on the first, fourth, sixth, second, and fifth surfaces, the second portion of the first arm is formed on at least the first and second surfaces, and the first and second feed terminals are located on the second surface.

* * * * *